US009105185B2

(12) United States Patent
Joglekar

(10) Patent No.: US 9,105,185 B2
(45) **Date of Patent: *Aug. 11, 2015**

(54) MANAGING TRAFFIC FLOW

(71) Applicant: INTERNATIONAL BUSINESS MACHINES CORPORATION, Armonk, NY (US)

(72) Inventor: Kaushik C. Joglekar, San Jose, CA (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/492,040

(22) Filed: Sep. 21, 2014

(65) Prior Publication Data

US 2015/0051823 A1 Feb. 19, 2015

Related U.S. Application Data

(63) Continuation of application No. 13/965,995, filed on Aug. 13, 2013.

(51) Int. Cl.
*G08G 1/01* (2006.01)
*G08G 1/00* (2006.01)

(52) U.S. Cl.
CPC ..... *G08G 1/0145* (2013.01)

(58) Field of Classification Search
None
See application file for complete search history.

(56) References Cited

U.S. PATENT DOCUMENTS

| | | | | |
|---|---|---|---|---|
| 5,532,690 | A | 7/1996 | Hertel | |
| 6,604,045 | B2 | 8/2003 | Kuroda et al. | |
| 7,899,611 | B2 | 3/2011 | Downs et al. | |
| 2005/0027447 | A1 * | 2/2005 | Hirose et al. | 701/210 |
| 2008/0262710 | A1 | 10/2008 | Li | |
| 2009/0204320 | A1 * | 8/2009 | Shaffer et al. | 701/202 |
| 2011/0310733 | A1 | 12/2011 | Tzamaloukas et al. | |
| 2012/0072096 | A1 | 3/2012 | Chapman et al. | |
| 2012/0226434 | A1 * | 9/2012 | Chiu | 701/117 |

OTHER PUBLICATIONS

"AT&T Customers Sidestep Road Congestion with TelNav Traffic", ATT.com, Jun. 7, 2007, published on the World Wide Web at: http://www.att.com/gen/press-room?pid=4800&cdvn=news&newsarticleid=23918.

"IBM Podcast Explores Smarter Traffic Systems", IBM.com, Dec. 1, 2008, published on the World Wide Web at: http://web.archive.org/web/20081205091851/http://www-03.ibm.com/press/us/en/pressrelease/26214.wss.

(Continued)

*Primary Examiner* — Yonel Beaulieu
*Assistant Examiner* — Krishnan Ramesh
(74) *Attorney, Agent, or Firm* — Paul S. Drake

(57) ABSTRACT

A method for tracking and routing traffic to avoid congestion via a plurality of user devices including providing a traffic reservation user interface for receiving a plurality of path selections from the plurality of user devices; responsive to predicting a traffic congestion from the plurality of user devices taking into account real-time and predicted conditions, presenting a first set of users with a first set of route selection recommendations via the user interface; and responsive to receiving a plurality of actual routing selections from the first set of users from the user interface, adjusting the traffic prediction, and presenting a second set of users with a second set of route selection recommendations via the user interface to reduce expected traffic congestion.

11 Claims, 8 Drawing Sheets

(56) References Cited

OTHER PUBLICATIONS

"Smart Traffic", IBM.com, Dec. 1, 2008, published on the World Wide Web at: http://www.ibm.com/ibm/ideasfromibm/us/smartplanet/topics/traffic/20081201/index.shtml?&re=spf.

"Capturing traffic data using GPS-enabled cell phones", Machineslikeus.com, Feb. 10, 2008, published on the World Wide Web at: http://web.archive.org/web/20081013102040/http://www.machineslikeus.com/cms/capturing-traffic-data-using-GPS-enabled-cell-phones.html.

Sadek et al, "Self-Learning Intelligent Agents for Dynamic Traffic Routing on Transportation Networks", 2008, NECSI.org, published on the World Wide Web at: http://necsi.org/events/iccs6/papers/5974cfbf44b65995d7fc325177c2.pdf.

"Get out of the Jam", Telenav.com, 2011, published on the World Wide Web at: http://web.archive.org/web/20110912145549/http://www.telenav.com/products/tn/traffic.html.

"Throw your maps away" Telenav.com, 2011, published on the World Wide Web at: http://web.archive.org/web/20110902010740/http://www.telenav.com/products/tn/features.html.

Whoriskey, "Beating Traffic by Joining the Network", The Washington Post, Washingtonpost.com, Mar. 25, 2008, published on the World Wide Web at: http://www.washingtonpost.com/wp-dyn/content/story/2008/03/24/ST2008032403495.html.

* cited by examiner

MANAGING TRAFFIC FLOW

This application is a continuation of application Ser. No. 13/965,995 filed Aug. 13, 2013 entitled "MANAGING TRAFFIC FLOW", the disclosure of which is incorporated in its entirety herein by reference.

BACKGROUND

1. Technical Field

The present invention relates generally to managing traffic flow, and in particular, to a computer implemented method for utilizing a route reservation system for managing traffic flow to avoid congestion.

2. Description of Related Art

Many cities worldwide experience increases in daily traffic on roads and highways faster than those roads and highways can be widened or new roads and highways built. As a result, congestion on those roads and highways continues to increase, thereby wasting time and money for those sitting or creeping in traffic as well as their employers. There are many causes of congestion when roads and highways are at or near full capacity, including bottlenecks, traffic accidents, bad weather, work zones, poor traffic signal timing, special events, etc.

As a result, cities and other governmental entities have implemented a variety of solutions to reduce traffic congestions including special commuter lanes for vehicles with two or more passengers, prepositioned tow trucks during rush hour to quickly handle vehicle breakdowns, live video cameras to monitor traffic, electronic billboards to warn drivers of road issues, etc. Even with these and other changes, the problems of congestion continue to worsen for many cities.

SUMMARY

The illustrative embodiments provide a method for tracking and routing traffic to avoid congestion via a plurality of user devices including providing a traffic reservation user interface for receiving a plurality of path selections from the plurality of user devices; responsive to predicting a traffic congestion from the plurality of user devices taking into account real-time and predicted conditions, at least one of which is selected from the group of road, traffic, and weather conditions, presenting a first set of users with a first set of route selection recommendations via the user interface; and responsive to receiving a plurality of actual routing selections from the first set of users from the user interface, adjusting the traffic prediction according to the predicted conditions and the actual routing selections, and presenting a second set of users with a second set of route selection recommendations via the user interface to reduce expected traffic congestion.

BRIEF DESCRIPTION OF THE SEVERAL VIEWS OF THE DRAWINGS

The novel features believed characteristic of the invention are set forth in the appended claims. The invention itself, further objectives and advantages thereof, as well as a preferred mode of use, will best be understood by reference to the following detailed description of illustrative embodiments when read in conjunction with the accompanying drawings, wherein:

DETAILED DESCRIPTION

Processes and devices may be implemented and utilized for managing traffic flow. These processes and apparatuses may be implemented and utilized as will be explained with reference to the various embodiments below.

Figure 1:
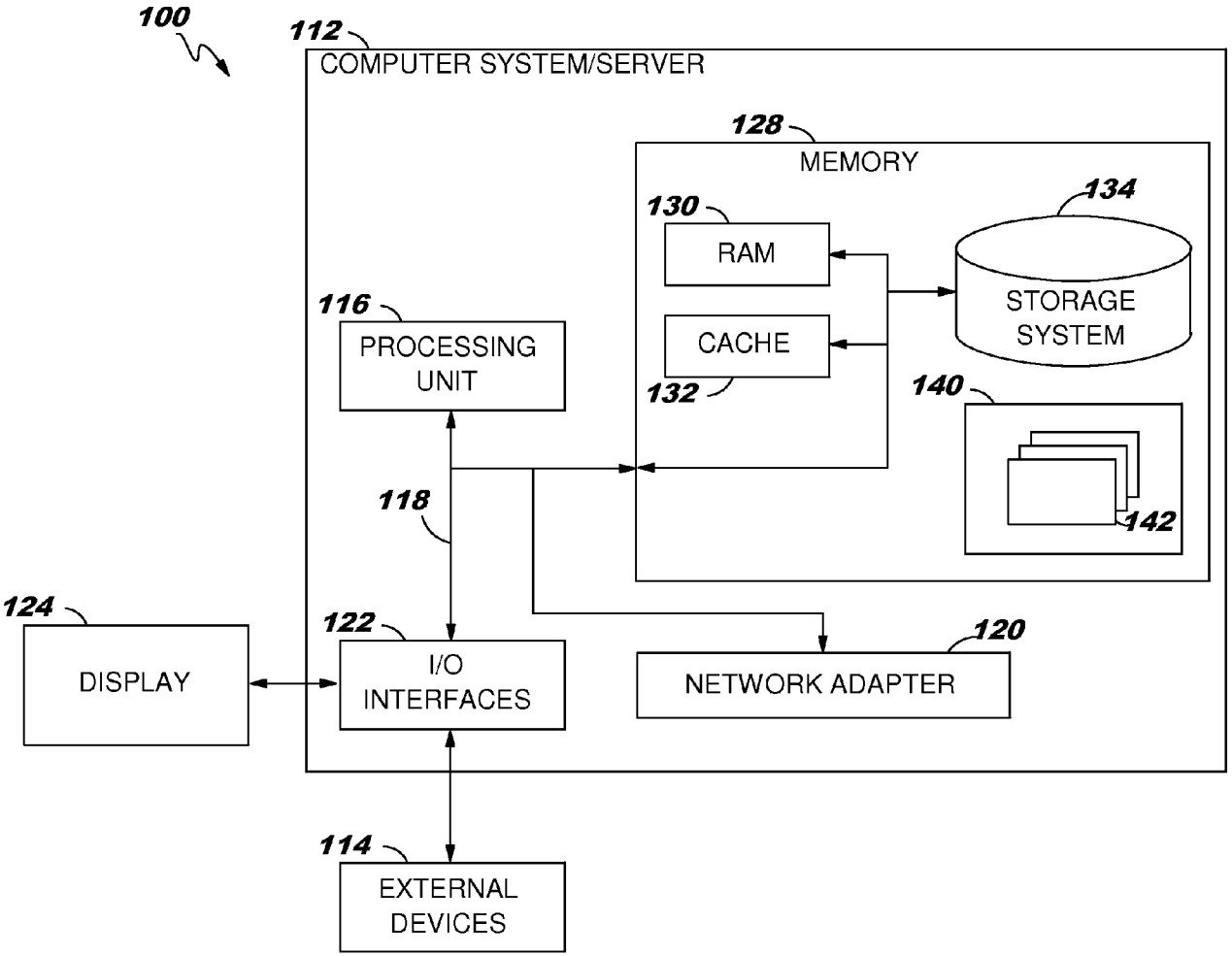
FIG. 1 is a block diagram of an illustrative data processing system in which various embodiments of the present disclosure may be implemented.

FIG. 1 is a block diagram of an illustrative data processing system in which various embodiments of the present disclosure may be implemented. Data processing system 100 is one example of a suitable data processing system and is not intended to suggest any limitation as to the scope of use or functionality of the embodiments described herein. Regardless, data processing system 100 is capable of being implemented and/or performing any of the functionality set forth herein such as managing traffic flow.

In data processing system 100 there is a computer system/server 112, which is operational with numerous other general purpose or special purpose computing system environments, peripherals, or configurations. Examples of well-known computing systems, environments, and/or configurations that may be suitable for use with computer system/server 112 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 112 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 112 may be practiced in distributed computing environments where tasks are performed by remote processing devices that are linked through a communications network. In a distributed computing environment, program modules may be located in both local and remote computer system storage media including memory storage devices.

As shown in FIG. 1, computer system/server 112 in data processing system 100 is shown in the form of a general-purpose computing device. The components of computer system/server 112 may include, but are not limited to, one or more processors or processing units 116, a system memory 128, and a bus 118 that couples various system components including system memory 128 to processor 116.

Bus 118 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 112 typically includes a variety of non-transitory computer system readable media. Such media may be any available media that is accessible by computer system/server 112, and it includes both volatile and non-volatile media, removable and non-removable media.

System memory 128 can include non-transitory computer system readable media in the form of volatile memory, such as random access memory (RAM) 130 and/or cache memory 132. Computer system/server 112 may further include other non-transitory removable/non-removable, volatile/non-volatile computer system storage media. By way of example, storage system 134 can be provided for reading from and writing to a non-removable, non-volatile magnetic media (not shown and typically called a "hard drive"). Although not shown, a USB interface for reading from and writing to a removable, non-volatile magnetic chip (e.g., a "flash drive"), and an optical disk drive for reading from or writing to a removable, non-volatile optical disk such as a CD-ROM, DVD-ROM or other optical media can be provided. In such instances, each can be connected to bus 118 by one or more data media interfaces. Memory 128 may include at least one program product having a set (e.g., at least one) of program modules that are configured to carry out the functions of the embodiments. Memory 128 may also include data that will be processed by a program product.

Program/utility 140, having a set (at least one) of program modules 142, may be stored in memory 128 by way of example, and not limitation, as well as an operating system, one or more application programs, other program modules, and program data. Each of the operating system, one or more application programs, other program modules, and program data or some combination thereof, may include an implementation of a networking environment. Program modules 142 generally carry out the functions and/or methodologies of the embodiments. For example, a program module may be software for managing traffic flow.

Computer system/server 112 may also communicate with one or more external devices 114 such as a keyboard, a pointing device, a display 124, etc.; one or more devices that enable a user to interact with computer system/server 112; and/or any devices (e.g., network card, modem, etc.) that enable computer system/server 112 to communicate with one or more other computing devices. Such communication can occur via I/O interfaces 122 through wired connections or wireless connections. Still yet, computer system/server 112 can communicate with one or more networks such as a local area network (LAN), a general wide area network (WAN), and/or a public network (e.g., the Internet) via network adapter 120. As depicted, network adapter 120 communicates with the other components of computer system/server 112 via bus 118. It should be understood that although not shown, other hardware and/or software components could be used in conjunction with computer system/server 112. Examples, include, but are not limited to: microcode, device drivers, tape drives, RAID systems, redundant processing units, data archival storage systems, external disk drive arrays, etc.

Figure 2:
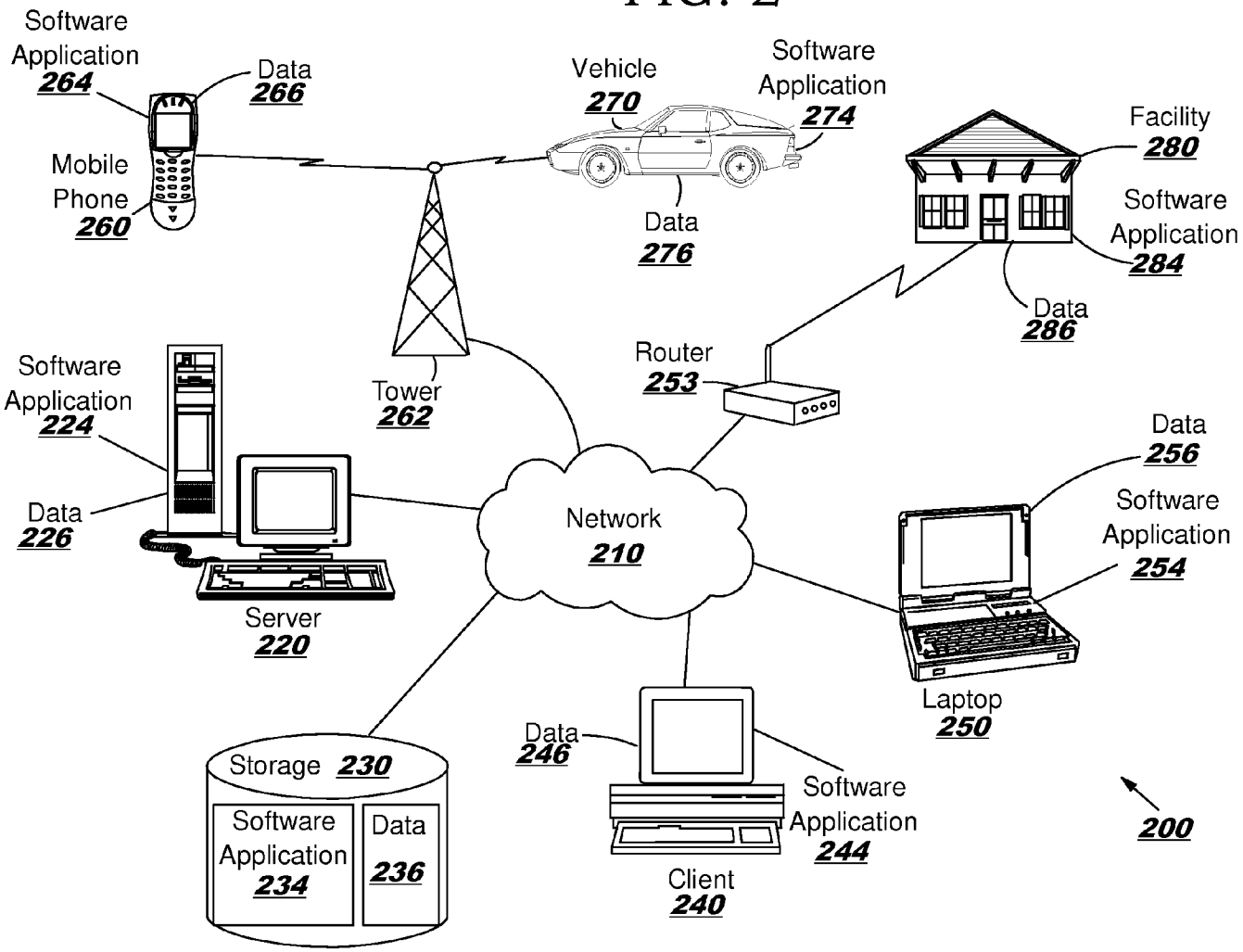
FIG. 2 is a block diagram of an illustrative network of data processing systems in which various embodiments of the present disclosure may be implemented.

FIG. 2 is a block diagram of an illustrative network of data processing systems in which various embodiments of the present disclosure may be implemented. Data processing environment 200 is a network of data processing systems such as described above with reference to FIG. 1. Software applications such as for managing traffic flow may execute on any computer or other type of data processing system in data processing environment 200. Data processing environment 200 includes network 210. Network 210 is the medium used to provide simplex, half duplex and/or full duplex communications links between various devices and computers connected together within data processing environment 200. Network 210 may include connections such as wire, wireless communication links, or fiber optic cables.

Server 220 and client 240 are coupled to network 210 along with storage unit 230. In addition, laptop 250 and facility 280 (such as a home or business) are coupled to network 210 including wirelessly such as through a network router 253. A mobile phone 260 and a vehicle 270 may be coupled to network 210 through a mobile phone tower 262. Data processing systems, such as server 220, client 240, laptop 250, mobile phone 260, vehicle 270 and facility 280 contain data and have software applications including software tools executing thereon. Other types of data processing systems such as personal digital assistants (PDAs), smartphones, tablets and netbooks may be coupled to network 210.

Server 220 may include software application 224 and data 226 for managing traffic flow or other software applications and data in accordance with embodiments described herein. Storage 230 may contain software application 234 and a content source such as data 236 for managing traffic flow. Other software and content may be stored on storage 230 for sharing among various computer or other data processing devices. Client 240 may include software application 244 and data 246. Laptop 250 and mobile phone 260 may also include software applications 254 and 264 and data 256 and 266. Vehicle 270 may include a navigation system or other hardware that includes software applications 274 and data 276. Facility 280 may include software applications 284 and data 286. Other types of data processing systems coupled to network 210 may also include software applications. Software applications could include a web browser, email, or other software application for managing traffic flow.

Server 220, storage unit 230, client 240, laptop 250, mobile phone 260, vehicle 270, facility 280 and other data processing devices may couple to network 210 using wired connections, wireless communication protocols, or other suitable data connectivity. Client 240 may be, for example, a personal computer or a network computer.

In the depicted example, server 220 may provide data, such as boot files, operating system images, and applications to client 240 and laptop 250. Server 220 may be a single computer system or a set of multiple computer systems working together to provide services in a client server environment. Client 240 and laptop 250 may be clients to server 220 in this example. Client 240, laptop 250, mobile phone 260, vehicle 270 and facility 280 or some combination thereof, may include their own data, boot files, operating system images, and applications. Data processing environment 200 may include additional servers, clients, and other devices that are not shown.

In the depicted example, data processing environment 200 may be the Internet. Network 210 may represent a collection of networks and gateways that use the Transmission Control Protocol/Internet Protocol (TCP/IP) and other protocols to communicate with one another. At the heart of the Internet is a backbone of data communication links between major nodes or host computers, including thousands of commercial, governmental, educational, and other computer systems that route data and messages. Of course, data processing environment 200 also may be implemented as a number of different types of networks, such as for example, an intranet, a local area network (LAN), or a wide area network (WAN). FIG. 2 is intended as an example, and not as an architectural limitation for the different illustrative embodiments.

Among other uses, data processing environment 200 may be used for implementing a client server environment in which the embodiments may be implemented. A client server environment enables software applications and data to be distributed across a network such that an application functions by using the interactivity between a client data processing system and a server data processing system. Data processing environment 200 may also employ a service oriented architecture where interoperable software components distributed across a network may be packaged together as coherent business applications.

Figure 3:
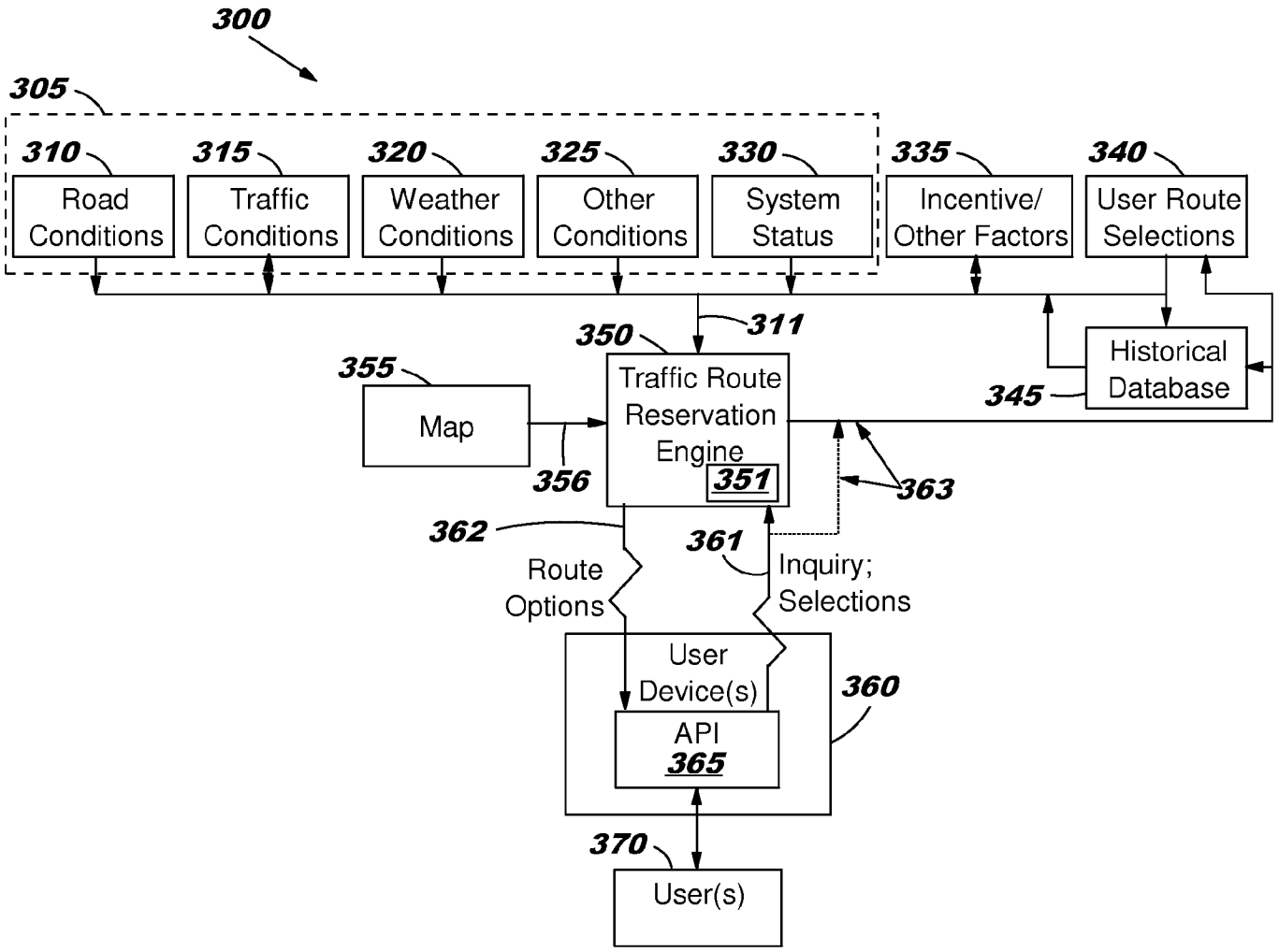
FIG. 3 is a block diagram of a system 300 for managing traffic flow in which various embodiments may be implemented.

FIG. 3 is a block diagram of a system 300 for managing traffic flow in which various embodiments may be implemented. Various public works inputs 305 for assisting in selecting routes for managing traffic flow include road conditions 310, traffic conditions 315, weather conditions 320, other conditions 325, and system status 330. Road conditions 310 can include predicted items such as scheduled road maintenance and road construction as well as real-time items such as unexpected construction work, potholes, etc. that can affect traffic flow. Such road information can come for a variety of sources including state, county and local road databases as well as other sources. Traffic conditions 315 can include predicted information such as scheduled events and predicted rush hour traffic loads and well as real-time information such as traffic flow by various measures such as average speed, traffic volume, etc. through incremental stretches of roads. Such predicted and real-time information can be from public works systems such as traffic monitoring systems or from public databases such as certain on-line searching engines and traffic maps. Weather conditions 320 includes predicted and real-time factors such as forecast or measured rain, snow, sleet and other precipitation, temperature, wind, sunrise and sunset information, and other weather factors which can affect traffic flow and flow. Such information can be gathered from public works systems such as NOAA (national oceanic and atmospheric administration) national weather service as well as other private and public sources. Other conditions 325 may also be utilized such as event planning and notification systems that can provide information regarding public events such as football games, concerts, etc. that can predictably cause traffic flow. System status information 330 such as whether certain databases or other sources of information are delayed or otherwise affected can also be provided.

Other types of inputs are also available including incentives and other factors 335. For example, tolls may be reduced or increased for certain areas to encourage or discourage travel along certain routes. Certain lanes may be by reservation only. Other incentives may be utilized including discounts on certain goods or services, parking spaces reserved close to destination, points towards certain clubs or airlines, or other monetary and non-monetary incentives.

Concurrent user route selections and reservations 340 may also be provided. These are routes chosen or assigned to other users of this system. These routes can be selections or reservations of route alternatives provided to other users of this system. A route may be composed of a set of segments, each segment having a limitation of traffic that can be handled without congestion, that limit changing based on current real-time conditions such as weather, traffic and road construction. Such information may also be stored by route segment in an historical database 345 for statistical analysis and utilization. For example, historical information can show which incentives work for certain user profiles to encourage alternative routes. Other types of statistical analysis may be useful for determining how best to encourage desirable user behavior in utilizing the system.

The above described inputs are then provided across communication line(s) 311 to a traffic route reservation engine 350 for managing traffic flow to avoid congestion. Engine 350 can also utilize input from a map 355 across communication line 356 for identifying various route alternatives with the above inputs. Engine 350 can be a data processing unit such as described above with reference to FIG. 1. A user 370 using a user device 360 can transmit a route inquiry across communication line 361 to engine 350 through an API (application program interface). The route inquiry can include a current or planned starting location, a destination, any preferences, and other factors which could assist the engine in determining the best alternative routes for the user given the other inputs provided above. Preferences and other factors can include whether the driver is disabled, avoids freeways, prefers less time driving over distance traveled, whether the driver wants to avoid tolls, etc. User device 360 may be a mobile device such as a smart phone with a cellular communication 361. Other mobile devices may be utilized including a notebook, a tablet, a GPS (global positioning system) unit such as a vehicle navigation system, etc. The user device may also be a less mobile device such as a home computer, work computer that the user can access prior to traveling. API 265 can be a smart phone app, a webpage, or other type of software interface for communicating with engine 350. Engine 350 can include an online route reservation marketplace 351 which allows users to trade, auction, or otherwise commoditize and assign to other vehicles and/or drivers. Use of such a marketplace is described in greater detail below.

Once the user sends an inquiry across communication line 361, engine 350 determines and provides one or more alternative routes across communication line 362 for the user to select. Such route choices can include travel distance, expected travel time, and other factors which can assist the user to make an informed decision. These route choices can also include incentives such as described above. Once received, the user can then make the selection and provide that selection to engine 350. The selection can then be utilized by engine 350 in providing alternative routes and incentives to other users as well as in providing travel times taking into account prior user selections. The user selection is also provided by engine 350 across communication line 363 to user route selection database 340 and historical database 345. The user selection provided can include information regarding incentives offered, alternatives provided, etc. for possible statistical analysis. To avoid latency, the user selection may be provided directly to user route selection database 340 and historical database 345 by API 365.

A system for managing traffic flow can be utilized for improving traffic congestion. For example, such as traffic flow system could enable drivers to select routes that coincide with the latest designated preferred routes to a given even or location or to avoid routes that are designated as undesirable routes, to enable event coordinators, sellers or local public works departments to reward preferred traffic behavior, to create markets for trading assigned traffic routings.

Figure 4:
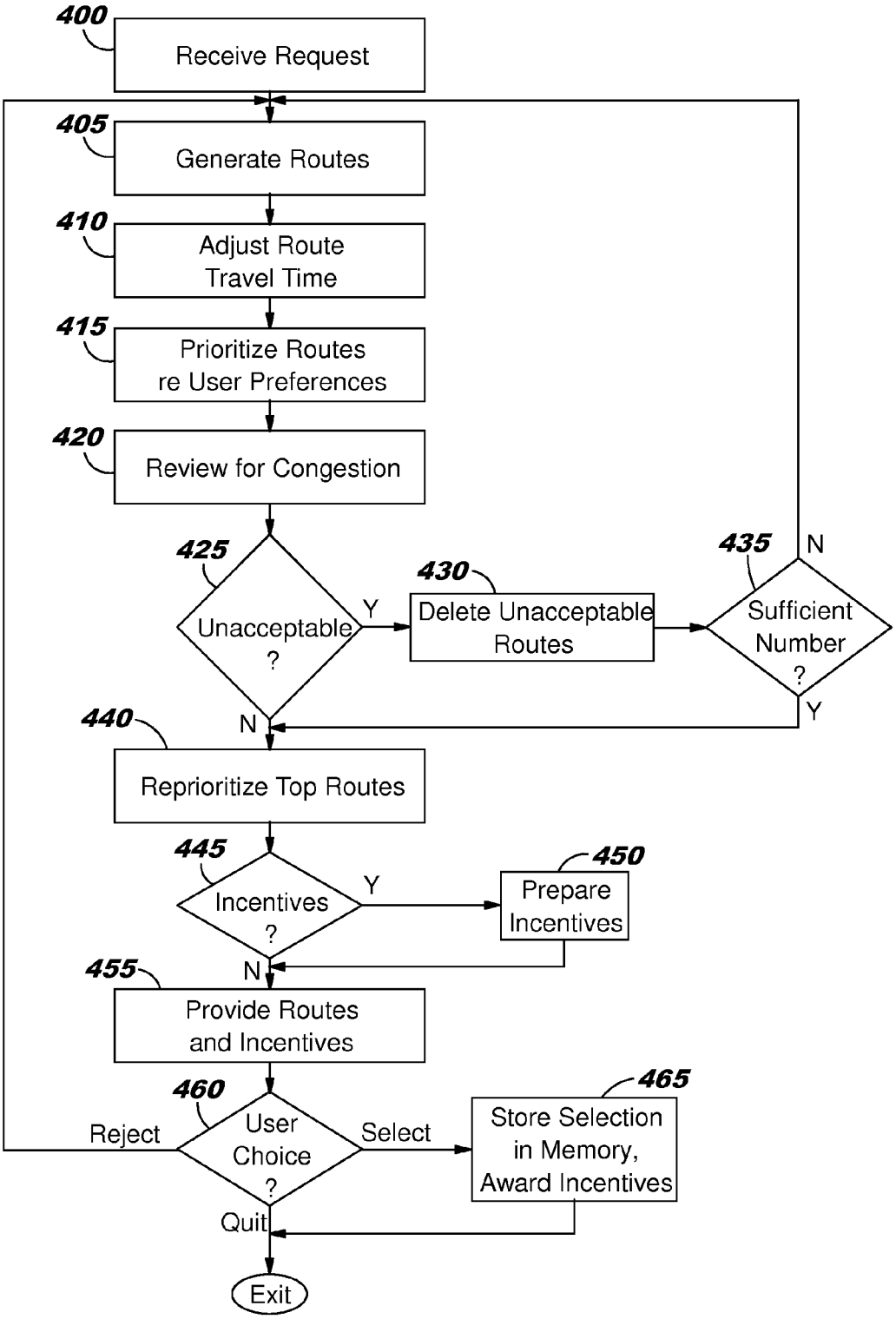
FIG. 4 is a flow diagram of a process for providing and selecting traffic routes for reservation in accordance with a first embodiment.

FIG. 4 is a flow diagram of a process for providing and selecting traffic routes for reservation in accordance with a first embodiment. In a first step 400, a traffic flow reservation engine receives a route request from a user. The request can include the start location of the user, the desired destination, any timing information such as start time and preferred destination time, any user preferences, whether there are passengers, the type of car (e.g., electric cars may be given priority), preferred paths (e.g., HOV lanes if passengers included), etc. The request can also include the identity of the user or vehicle, the user's vehicle license plate, or other identifying information of the user for tracking and statistical purposes. The request can be a single set of contained data, it can be provided through a query based interaction through a website, or other types of information exchange. Certain of these items such as user preferences may be previously stored in a database by the user as standard preferences. The request may be received from previously or concurrently downloaded application on a smart phone, through an internet website user interface, or other form of user application program interface (API). If through a smart phone application, the application may utilize the GPS unit of that phone may provide updated information during route travel to provide feedback of traffic speed for that route as well as other information such as whether the user is traveling an alternative route, perhaps due to unexpected traffic congestion over the reserved route.

In response to the request, in step 405 the reservation engine generates various alternative routes meeting the preferences of the user with travel distances and estimated travel time based on historical data. This historical data can include the day of the week, the time of day, and other repeating historical information. Alternative routes can include alternative times of travel, particularly if the user is reserving a route ahead of time. A route may be composed of a set of segments, each segment having a limitation of traffic that can be handled without congestion, that limit changing based on current real-time conditions such as weather, traffic and road construction. Then in step 410, those estimated travel times are adjusted based on current and expected traffic, weather, special events, road conditions, etc. as well as route selections of other users. These adjustments are generally based on real-time or current conditions that may not have been predicted from historical information, although such historical information may be useful in determining the effects of current conditions (e.g., effect of rain on traffic patterns and congestion). Subsequently in step 415, the routes are then initially prioritized based on user preferences (e.g., time versus distance). For example, the user may need to be at a certain location by a certain time. In such a case, the user is mostly time sensitive unless there are several routes which would meet the user's time constraints, in which case the user may prefer the route with the shortest distance that meets the user's time constraints. Alternatively, preferences of the metropolitan area may also be utilized to prioritize the routes. For example, if there is a desire to reduce downtown traffic during certain periods of time, then routes through downtown may be reduced in priority based on those criteria.

In step 420, the routes are then reviewed for choke points or unacceptable traffic congestion. This can include looking at expected congestion based on predicted road, traffic and weather conditions including historical patterns, weather forecasts, planned road construction, etc. If the reservation is requested close to the time of travel, current conditions may be utilized as well such as from video cameras or under-road detectors of vehicle traffic, accident reports, etc. Unacceptable traffic congestion may include determining that too many users have reserved the same route segment(s) at the same time of travel. That is, prior route selections of other users can be utilized to predict traffic congestion. If certain routes are determined to be unacceptably congested in step 425, then processing continues to step 430, otherwise processing continues to step 440. In step 430, unacceptable routes are deleted from the set which may be shown to the user. That is, some routes may not be shown to the user as an option as no more persons should be sent on those routes due to excessive congestion. For example, if a highway is closed due to a bad accident and users can only travel on the access roads to that highway, all users may be directed to other routes until the route has been cleared. This allows for emergency vehicles such as ambulances to more easily travel to the accident location. In step 435, it is determined whether there are a sufficient number of routes remaining for the user to choose from (e.g., at least three). A single route may be sufficient in some applications. If there are not a sufficient number of acceptable routes, then processing returns to step 405 for generating more routes, otherwise processing continues to step 440. In step 440, the top remaining routes according to user preferences (e.g., top five) are then reprioritized based on avoiding congestion unless the user directs otherwise. That is, users are encouraged to utilize routes that do not add to traffic congestion.

In step 445, it is determined whether incentives should be provided to the user based on the amount of congestion for certain routes and the effect on user preferences. For example, if the best route from a user preference perspective is the worst route from a congestion perspective, then certain incentives may be provided to the user. This allows for accommodations to the user when the interests of the user (user preferences) differ from the interests of the public (to reduce congestion). If yes in step 445, then processing continues to step 450, otherwise processing continues to step 455. In step 450, those incentives are generated and prepared for offering to the user. For example, those incentives can include "green points", reduced tolls, etc. Processing then continues to step 455.

In step 455, the top remaining routes including any incentives are shown to the user for selection. These routes do not include any unacceptable routes per step 430 above and are prioritized according to congestion avoidance. In some applications, a single route may be displayed to the user. In step 460, the user then either rejects these choices, makes a selection, or exits processing without a selection. If rejected, then processing returns to step 405 above for further route generation. If a route is selected, then processing continues to step 465 where the user selection is documented as a reservation and stored in memory for use in determining congestion for other users. This reservation may include multiple road segments reserved at certain time periods, and each such road segment reservation may identify the driver and a queue position for that drive. The queue position may be based on when the reservation was made or on other factors such as whether the driver has a good record of utilizing his or her assigned reservations on time. In addition, any incentives accepted by the user are awarded to that user. Processing then exits.

Figure 5:
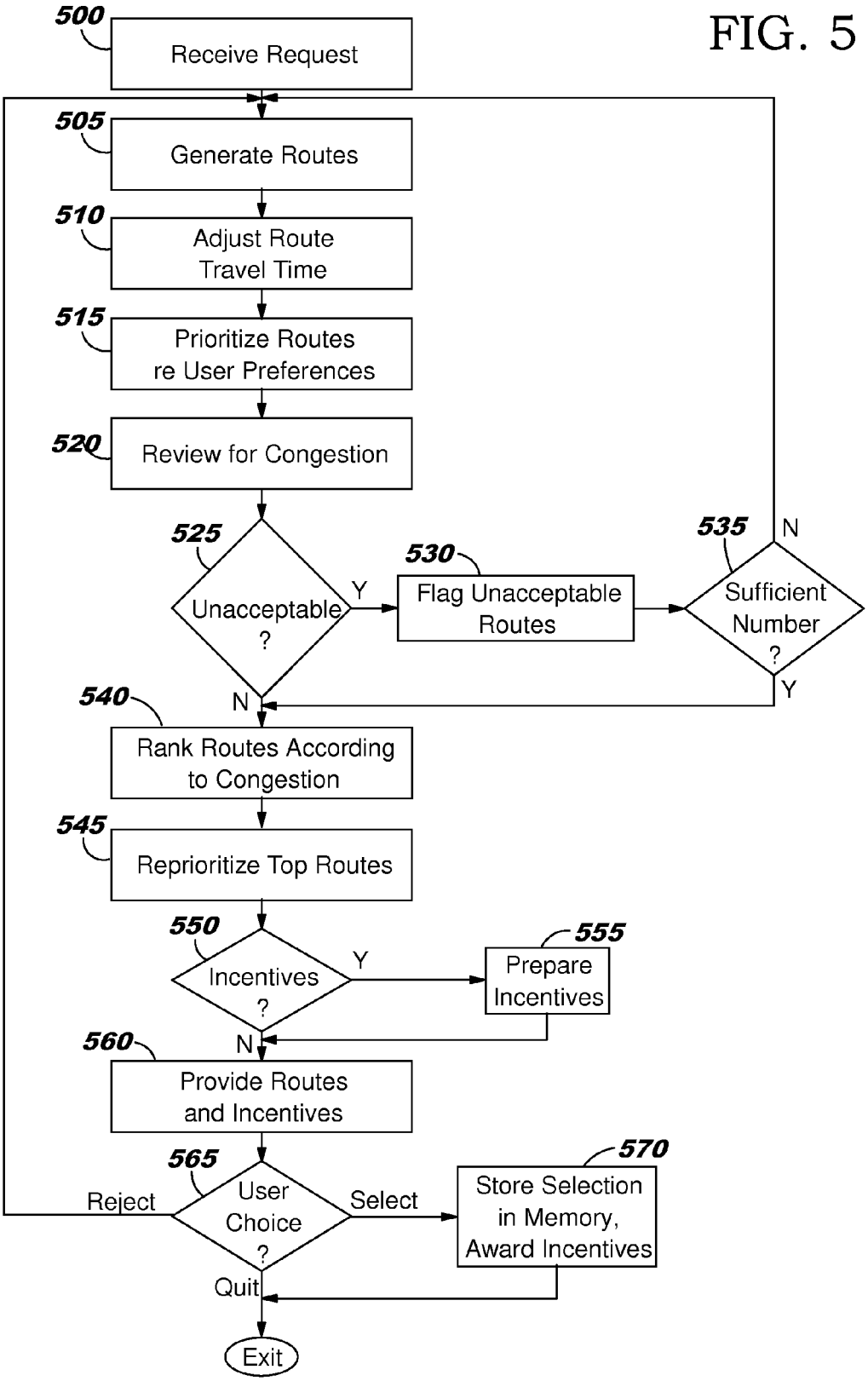
FIG. 5 is a flow diagram of a process for providing and selecting traffic routes for reservation in accordance with a second embodiment.

FIG. 5 is a flow diagram of a process for providing and selecting traffic routes for reservation in accordance with a second embodiment. In a first step 500, a traffic flow reservation engine receives a route request from a user. The request can include the start location of the user, the desired destination, any timing information such as start time (the user may reserve routes ahead of time) and preferred destination time, any user preferences, whether there are passengers, the type of car (e.g., electric cars may be given priority), preferred paths (e.g., HOV lanes if passengers included), etc. The request can also include the identity of the user or vehicle, the user's vehicle license plate, or other identifying information of the user for tracking and statistical purposes. The request can be a single set of contained data, it can be provided through a query based interaction through a website, or other types of information exchange. Certain of these items such as user preferences may be previously stored in a database by the user as standard preferences. The request may be received from previously or concurrently downloaded application on a smart phone, through an internet website user interface, or other form of user application program interface (API). If through a smart phone application, the application may utilize the GPS unit of that phone may provide updated information during route travel to provide feedback of traffic speed for that route as well as other information such as whether the user is traveling an alternative route, perhaps due to unexpected traffic congestion over the reserved route.

In response to the request, in step 505 the reservation engine generates various alternative routes meeting the preferences of the user with travel distances and estimated travel time based on historical data. This historical data can include the day of the week, the time of day, and other repeating historical information. Alternative routes can include alternative times of travel, particularly if the user is reserving a route ahead of time. A route may be composed of a set of segments, each segment having a limitation of traffic that can be handled without congestion, that limit changing based on current conditions such as weather and road construction. Then in step 510, those estimated travel times are adjusted based on current and expected traffic, weather, special events, road conditions, etc. as well as route selections of other users. These adjustments are generally based on real-time or current conditions that may not have been predicted from historical information, although such historical information may be useful in determining the effects of current conditions (e.g., effect of rain on traffic patterns and congestion). Subsequently in step 515, the routes are then initially prioritized based on user preferences (e.g., time versus distance). For example, the user may need to be at a certain location by a certain time. In such a case, the user is mostly time sensitive unless there are several routes which would meet the user's time constraints, in which case the user may prefer the route with the shortest distance that meets the user's time constraints. Alternatively, preferences of the metropolitan area may also be utilized to prioritize the routes. For example, if there is a desire to reduce downtown traffic during certain periods of time, then routes through downtown may be reduced in priority based on those criteria.

In step 520, the routes are then reviewed for choke points or unacceptable traffic congestion. This can include looking at expected congestion based on predicted road, traffic and weather conditions including historical patterns, weather forecasts, planned road construction, etc. If the reservation is requested close to the time of travel, current conditions may be utilized as well such as from video cameras or under-road detectors of vehicle traffic, accident reports, etc. Unacceptable traffic congestion may include determining that too many users have reserved the same route segment at the same time of travel. That is, prior route selections of other users can be utilized to predict traffic congestion. If certain routes are determined to be unacceptably congested in step 525, then processing continues to step 530, otherwise processing continues to step 540. In step 530, unacceptable routes are flagged for special processing as described below. That is, some routes may be shown to the user with special notification or with special considerations as no more persons should be sent on those routes due to excessive congestion. For example, if a highway is closed due to a bad accident and users can only travel on the access roads to that highway, all users interested in that route may be provided an explanation of why that route should not be taken until the route has been cleared. This allows for emergency vehicles such as ambulances to more easily travel to the accident location. In step 535, it is determined whether there are a sufficient number of acceptable routes generated for the user to choose from (e.g., at least three). If not, then processing returns to step 505 for generating more routes, otherwise processing continues to step 540. In step 540, the routes not flagged above are ranked according to congestion. That is, the amount of delays that a user may expect for a given route is utilized for ranking the routes. This can be utilized to identify those routes where user preferences are in conflict with expected congestion. That is, users may be encouraged to utilize routes that do not add to traffic congestion. In step 545, the routes are then prioritized from a combination of user preferences and congestion. That is, those that are not flagged as unacceptably congested are ranked by user preferences followed by those that are flagged also ranked by user preferences. Charges may also be levied for unacceptable routes. That is, the driver may choose an unacceptable route, but may lose points or be charged certain fees by selecting an unacceptable route.

In step 550, it is determined whether incentives should be provided to the user based on the amount of congestion for certain routes and the effect on user preferences. For example, if the best route(s) from a user preference perspective is flagged as an unacceptable route or is one of the worst ranked routes from a congestion perspective, then certain incentives may be provided to the user. This allows for accommodations to the user when the interests of the user (user preferences) differ from the interests of the public (to reduce congestion). If yes in step 550, then processing continues to step 555, otherwise processing continues to step 560. In step 555, those incentives are generated and prepared for offering to the user. For example, those incentives can include "green points", reduced tolls, etc. Processing then continues to step 560.

In step 560, the top routes including any incentives are shown to the user for selection. Those that are flagged as unacceptably congested are highlighted in red or otherwise indicated as such. In step 565, the user then either rejects these choices, makes a selection, or exits processing without a selection. If rejected, then processing returns to step 505 above for further route generation. If a route is selected, then processing continues to step 570 where the user selection is documented as a reservation and stored in memory for use in determining congestion for other users. This reservation may include multiple road segments reserved at certain time periods, and each such road segment reservation may identify the driver and a queue position for that drive. The queue position may be based on when the reservation was made or on other factors such as whether the vehicle has multiple occupants. In addition, any incentives accepted by the user are awarded to that user. Processing then exits.

Figure 6:
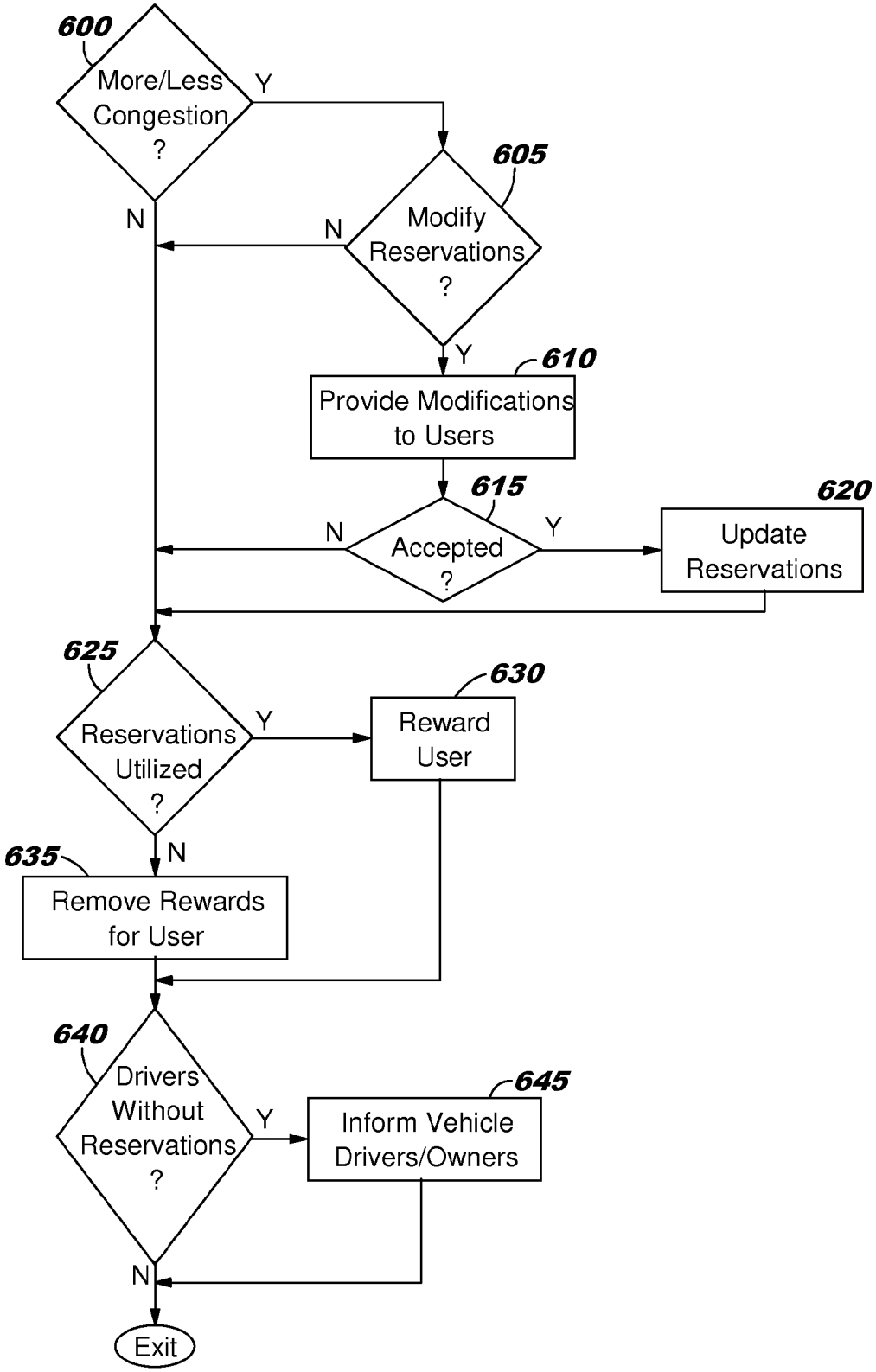
FIG. 6 is a flow diagram of the operation of a system for managing traffic route reservations in which various embodiments may be implemented.

FIG. 6 is a flow diagram of the operation of a system for managing traffic route reservations in which various embodiments may be implemented. This process can be performed at any time, including repeatedly, once some users have made reservations such as described with reference to FIGS. 4 and 5 above. Each driver/vehicle has a queue position with each route segment reserved for each time period. For example, 1000 drivers or vehicles may have a reservation for a particular stretch of highway between two identified exits within a 15 minute time period. Each such driver or vehicle may be assigned a queue position based on when the reservation was made or whether the vehicle is an electric or hybrid vehicle.

In a first step 600, it is determined whether any of the road segments have substantially more or less congestion than expected. This information can come from accident reports, congestion readings such as from video cameras or under-road detectors of vehicle traffic, accident reports, etc. It can also include route reservations or cancellations. If yes in step 600, then in step 605 it is determined whether certain route reservations may be modified to adapt to the congestion readings. If yes in step 605, then in step 610 route adjustments may be sent to various users to make those adjustments based on queue position and the current location of a user. For example, if a set of road segments have less congestion than expected, then high priority users (based on queue position) which could take advantage of that less congestion are notified of the alternative route and are offered the opportunity to select the alternative less congested route. This can occur before the user starts his or her route or may occur while the user is in transit. If while in transit, then the information may be provided such that it does not disrupt the driving of the user such as by automated voice communication through the user's smart phone or navigation system. For another example, if a set of road segments have more congestion than expected, then low priority users (based on queue position) may be requested to take an alternative route to relieve that congestion, perhaps with incentives. Alternatively, high priority users may be offered these alternative routes. If the offers are selected/accepted in step 615 (which may be accomplished through a voice command if the user is in transit), then in step 620 the queues for each route segment are updated accordingly. If no in steps 600, 605 or 615, or after step 620, processing then continues to step 625.

In step 625, it is determined whether users are properly utilizing the reservations provided to them earlier. This can be performed if the users have smartphones and applications that allow GPS coordinates to be sent to the reservation system. Alternatively, license plates of vehicles can be identified through video cameras or toll tags may be read (even if not charged) to identify vehicles. In yes in step 625, then in step 630 the user utilizing a reservation properly during the reservation time, then that user may be assigned an award, be given a higher priority for receiving a better queue number for future reserved route segments, etc. Processing then continues from step 630 to step 640. If no in step 625, then in step 635 the user not utilizing a reservation properly during the reservation time may be docked points, be given a lower priority for receiving a lower queue number for future reserved route segments, etc. Process then continues to step 640.

In step 640, vehicles and drivers on the roads that do not have reservations may be identified. If yes, then in step 645 the owners of those vehicles or the drivers may then be sent information regarding the reservation system and how it can be utilized. For example, where identified an email or regular mail may be sent to those owners and drivers not utilizing the reservation system. Processing then either exits or returns to step 600 above for repeating periodically.

A market place for route reservations may be implemented for various embodiments. That is, route reservations or segments thereof may be traded, auctioned, or otherwise commoditized and assigned to other vehicles and/or drivers. In such a case, an online marketplace may be set up for such activities such as shown as element 351 in FIG. 3 above. For example, a user may make a reservation for traveling a particular route periodically then find that a vacation or business travel will occur instead for a particular date. As a result, the user may wish to trade or auction the route rather than cancel the route or simply take no action and not utilize the scheduled route. An additional example a user may wish to leave late from work to go home due to unforeseen circumstances at work or at home. As a result the user may wish to gain credit for traveling during non-peak times and be placed in higher queue during the next planned trip. For another example, a user may automatically be allowed to obtain a priority route reservation when acquiring a ticket to a special event such as a symphony. When the ticket is acquired, the user may then make a reservation from his or her place of business or residence to and from the venue including reserving and paying for parking in a designated area or parking spot. The priority for the route reservation and the most direct route may depend on several factors such as price paid for the event ticket, whether the ticket was purchased earlier or later, etc. For a third example, a business entity may acquire a set of tickets for a special event such as a concert with a set of route segment reservations to travel to and/or exit the venue, possibly including parking reservations. Such routes may be a valuable commodity and may be allowed to be exchanged in a managed on-line marketplace. Such a marketplace can establish a value for route reservations thereby increase the desirability of making those route reservations. That value may be monetary, points, coupons, or other items of value to users.

Figure 7:
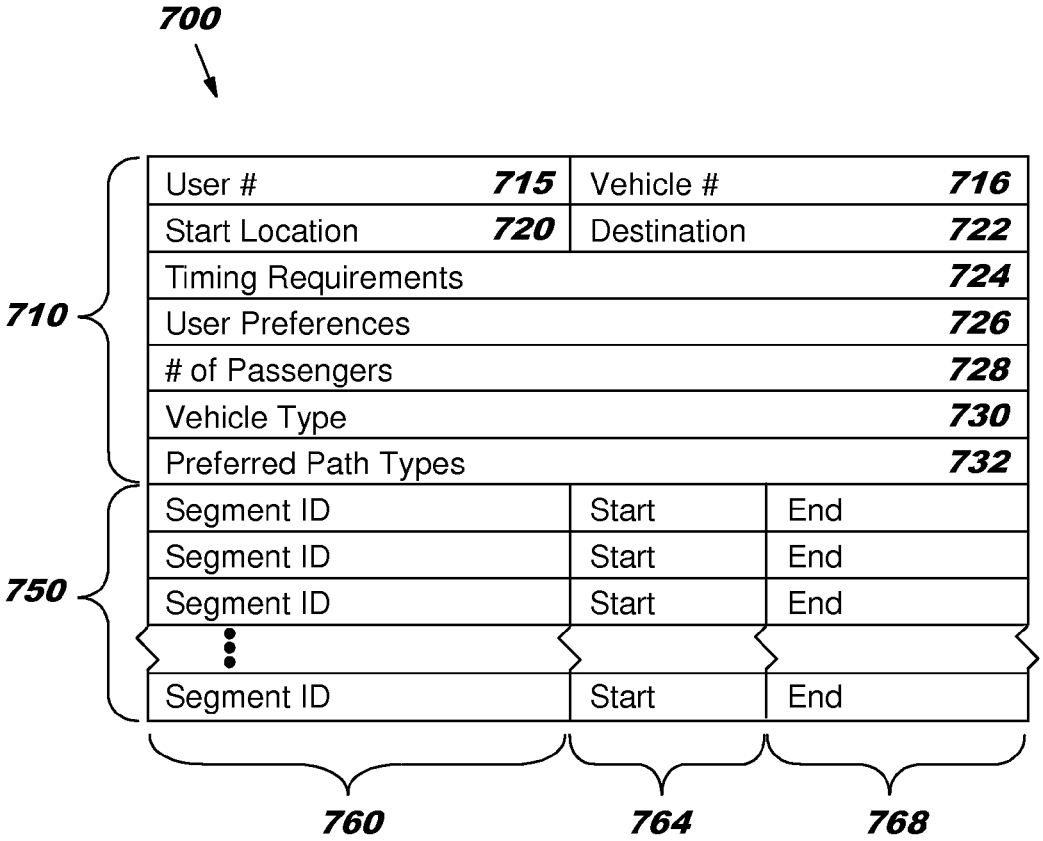
FIG. 7 is a block diagram of a route reservation 700 in a database in which various embodiments may be implemented.

FIG. 7 is a block diagram of a route reservation 700 in a database in which various embodiments may be implemented. The route reservation may be generated utilizing a smartphone application, an internet website user interface, or other form of user application program interface (API). The route reservations may be stored in a database such as elements 340 and 345 of FIG. 3.

Each route reservation 700 includes header information 710 and route information 750. Header information 710 includes user or vehicle identification such as a user driver's license number 715 and a vehicle license plate number 716. The vehicle license plate number may be utilized for tracking or statistical purposes. For example, the vehicle license plate number 716 may be compared with license plate numbers identified with video cameras located throughout the metropolitan area. Also included in header 710 are the start location of the user 720 (which can be a specific address or a general area for privacy protection purposes), the desired destination 722, any timing information 724 such as start time and preferred destination time, any user preferences 726, whether there are passengers 728, the type of vehicle (e.g., electric cars may be given priority) 730, preferred path types (e.g., HOV lanes if passengers included) 732, etc. Additional information can be included in header 710 including priority. Some header information such as information about the driver or the vehicle may be contained in a separate centralized database linked by driver or vehicle identifiers (IDs).

Route information 750 includes a series of contiguous route segments, each route segment including a route segment identifier (ID) 760, a start time 764 and an end time 768. The segment ID can correspond to segments of a map database of the map area (e.g. a metropolitan area). The start time and the end time can be calculated based on congestion, weather, etc. and can be adjusted according to real-time information such as weather, accidents, etc.

Additional or different information may be captured and stored in such a database of route information. This information may be linked through identifiers with other databases. Statistical information may be captured and/or derived from such route information to assist in improving the predicting congestion and in rerouting traffic to avoid or prevent such congestion.

Figure 8:
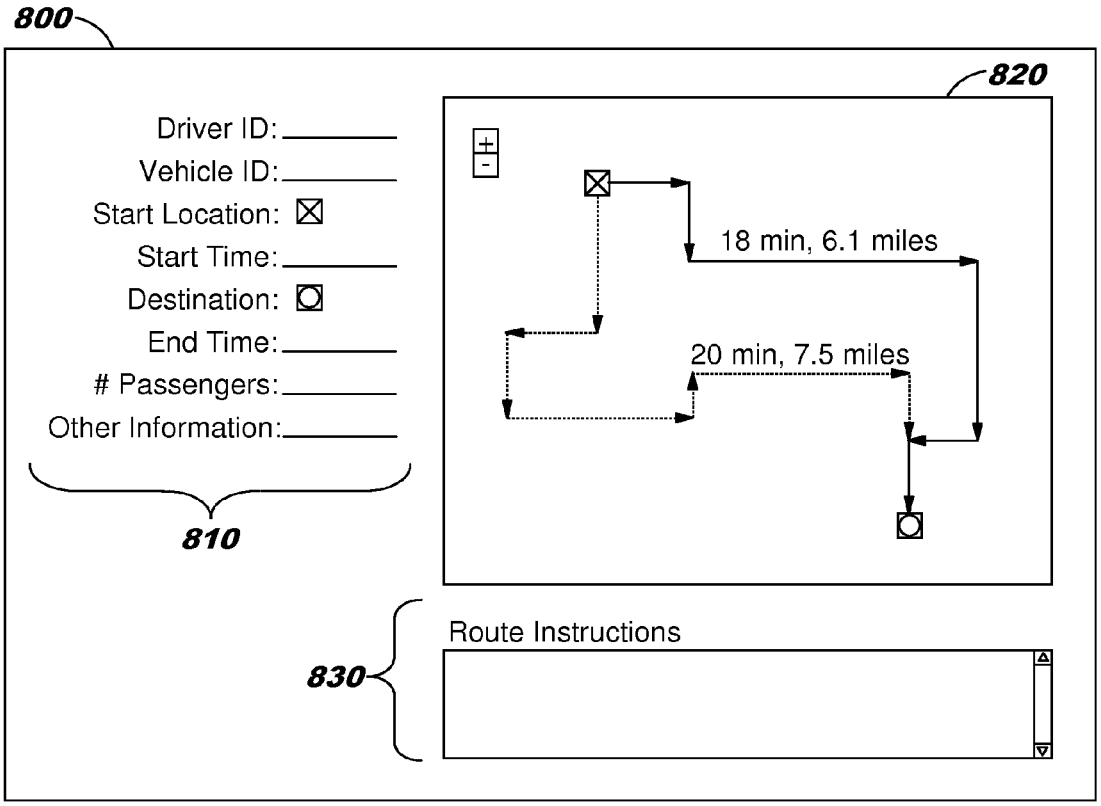
FIG. 8 is a diagram of a user interface for utilizing the route reservation system in which various embodiments may be implemented.

FIG. 8 is a diagram of a user interface 800 for utilizing the route reservation system in which various embodiments may be implemented. This user interface 800 may be utilized from a previously or concurrently downloaded application on a smart phone, through an internet website user interface, or other form of user application program interface (API).

There are three main parts to this user interface 800, a data entry and display area 810, a map interface 820 and a route instruction area 830. Data entry and display area 810 may be utilized to enter information or to display previously entered information such as vehicle information accessed from a separate database through the vehicle identifier.

Map interface 820 is utilized to display a map where the desired route can be selected and displayed. For example, the user may utilize a cursor and mouse or other user interface device to select a start location (which is identified with an X) and a destination (which is identified with a circle). Two or more route choices may be displayed with the recommended route choice shown as a solid line and a secondary choice shown as a dotted line. Expected time and distance information may also be displayed. The user can then select the desired route from these choices. Route instruction area 830 can then be utilized to provide route details. Such information can be provided by voice through a GPS map device or the like. Many other types of user interfaces may be utilized to capture and display the desired information for the user.

The invention can take the form of an entirely software embodiment, or an embodiment containing both hardware and software elements. In a preferred embodiment, the embodiments are implemented in software or program code, which includes but is not limited to firmware, resident software, and microcode.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM), or Flash memory, an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Further, a computer storage medium may contain or store a computer-readable program code such that when the computer-readable program code is executed on a computer, the execution of this computer-readable program code causes the computer to transmit another computer-readable program code over a communications link. This communications link may use a medium that is, for example without limitation, physical or wireless.

A data processing system suitable for storing and/or executing program code will include at least one processor coupled directly or indirectly to memory elements through a system bus. The memory elements can include local memory employed during actual execution of the program code, bulk storage media, and cache memories, which provide temporary storage of at least some program code in order to reduce the number of times code must be retrieved from bulk storage media during execution.

A data processing system may act as a server data processing system or a client data processing system. Server and client data processing systems may include data storage media that are computer usable, such as being computer readable. A data storage medium associated with a server data processing system may contain computer usable code such as for managing traffic flow. A client data processing system may download that computer usable code, such as for storing on a data storage medium associated with the client data processing system, or for using in the client data processing system. The server data processing system may similarly upload computer usable code from the client data processing system such as a content source. The computer usable code resulting from a computer usable program product embodiment of the illustrative embodiments may be uploaded or downloaded using server and client data processing systems in this manner.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to explain the principles of the invention, the practical application, and to enable others of ordinary skill in the art to understand the invention for various embodiments with various modifications as are suited to the particular use contemplated.

The terminology used herein is for the purpose of describing particular embodiments and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method of tracking and routing traffic to avoid congestion via a plurality of user devices comprising:

providing a traffic reservation interface for receiving a plurality of path selections from the plurality of user devices;

responsive to predicting a traffic congestion from the plurality of user devices taking into account real-time and predicted conditions, at least one of which is selected from the group of road, traffic, and weather conditions, providing a first set of users with a first set of route selection recommendations via the interface; and responsive to receiving a plurality of actual routing selections from the first set of users to the first set of route selection recommendations through the interface, adjusting the traffic prediction according to the predicted conditions and the actual routing selections from the first set of users, and providing a second set of users with a second set of route selection recommendations based on the adjusted traffic prediction via the interface to reduce expected traffic congestion.

2. The method of claim 1 wherein the plurality of user devices includes mobile devices; and wherein the interface comprises an application programming interface (API).

3. The method of claim 2 wherein the mobile devices are selected from a group consisting of a smart phone, a notebook, a tablet and a GPS unit.

4. The method of claim 3 further comprising tracking selected routes during route usage; notifying users of alternate routes due to increased congestion in the selected routes; and providing incentives for notified users to utilize the alternate routes; wherein the predicted conditions includes scheduled road maintenance, scheduled road construction, scheduled events, predicted rush hour traffic loads, and weather forecasts; wherein the second set of route selection recommendations does not include routes which are predicted to be congested based on the adjusted traffic prediction; and wherein the second set of route selection recommendations includes incentives offered to the second set of users to avoid selecting routes which are predicted to be congested based on the adjusted traffic prediction.

5. The method of claim 1 wherein the predicted conditions includes scheduled road maintenance, scheduled road construction, scheduled events, predicted rush hour traffic loads, and weather forecasts.

6. The method of claim 1 wherein the second set of route selection recommendations does not include routes which are predicted to be congested based on the adjusted traffic prediction.

7. The method of claim 1 wherein the second set of route selection recommendations includes incentives offered to the second set of users to avoid selecting routes which are predicted to be congested based on the adjusted traffic prediction.

8. The method of claim 7 wherein the incentives are based on statistical analysis of prior incentives accepted by the second set of users.

9. The method of claim 1 further comprising tracking selected routes during route usage; notifying users of alternate routes due to increased congestion in the selected routes; and providing incentives for notified users to utilize the alternate routes.

10. The method of claim 1 further comprising obtaining feedback from the first set of users during route travel; and wherein adjusting the traffic prediction includes utilizing the feedback.

11. The method of claim 10 wherein the feedback includes whether the first set of users are travelling the actual routing.

* * * * *